United States Patent [19]

Shikhirev et al.

[11] 4,204,370

[45] May 27, 1980

[54] APPARATUS FOR WORKING SHEET MATERIALS WITH FERROMAGNETIC POWDER

[76] Inventors: Boris N. Shikhirev, Novoalexeevskaya ulitsa, 1, kv. 146; Evgeny A. Matrosov, 2 Filevskaya ulitsa, 10/13, korpus 1, kv. 64; Ilya A. Deresh, Krasnokholmskaya naberezhnaya, 1/15, kv. 343, all of Moscow, U.S.S.R.

[21] Appl. No.: 910,738

[22] Filed: May 30, 1978

[51] Int. Cl.[2] ..... B24B 7/12

[52] U.S. Cl. ..... 51/80 A; 51/317

[58] Field of Search ..... 51/22, 23, 75, 76 R, 51/80 A, 80 R, 263, 292, 317, 430

[56] References Cited

U.S. PATENT DOCUMENTS

| | | | |
|---|---|---|---|
| 588,441 | 8/1897 | Kann | 51/292 |
| 1,899,463 | 2/1933 | Howard | 51/80 A |
| 2,483,277 | 9/1949 | Hamilton | 51/80 A |
| 3,898,769 | 8/1975 | Makedonski et al. | 51/292 X |
| 4,040,209 | 8/1977 | Shikhirev et al. | 51/80 A |

FOREIGN PATENT DOCUMENTS

| | | | |
|---|---|---|---|
| 539743 | 12/1976 | U.S.S.R. . | |
| 534351 | 2/1977 | U.S.S.R. | 51/328 |

*Primary Examiner*—Gary L. Smith
*Assistant Examiner*—Robert P. Olszewski
*Attorney, Agent, or Firm*—Burgess, Ryan and Wayne

[57] ABSTRACT

An apparatus is provided with two rolls made of a magnetically conductive material, spaced to define a passage for a sheet being worked. Either at the first ends, or at both ends of the rolls there are provided means for inducing a magnetic field, so arranged that the magnetic lines extend axially of the rolls and cross the gap therebetween, whereby the rolls act as the opposite pole pieces of a single magnetic system and are designed to retain the ferromagnetic powder which, with the rolls rotating, is pulled through the gap therebetween in a layer used to work the sheet material. The apparatus incorporates a device for levelling out the distribution of the grains of the ferromagnetic powder throughout the length of the gap. The device can be made in the form of a blade positioned to cut off a part of the magnetic powder body at the extremities of the rolls, which enhances the uniform distribution of the grains. The invention also provides for the rolls having tapering portions at their extremities, whereby the magnetic flux density at these extremities is reduced and made substantially equal to the density centrally of the rolls.

10 Claims, 8 Drawing Figures

APPARATUS FOR WORKING SHEET MATERIALS WITH FERROMAGNETIC POWDER

The present invention relates to machining by abrasion. More particularly, it relates to an apparatus for working sheet materials with ferromagnetic powder which can be used for machining semi-finished printed boards of various radioelectronic deivces. However, the present invention can be used advantageously in other arts and industries, wherever it is desirous to obtain sheet materials or stock with a high quality of surface machining over the entire surface of a workpiece.

There is already known an apparatus for working sheet materials, for which an application titled "Device for the treatment of sheet materials" was filed by I. A. Deresh et al. with the United States Patent Office, Ser. No. 629,631; 1975, for which U.S. Pat. No. 4,040,209 has been issued.

The apparatus comprises a magnetic system for retaining or holding the abrasive powder in the machining zone defined by two cylindrical rolls made of a magnetically conductive material and spaced to define therebetween a gap for the passage of a sheet being worked, the rolls being mounted for rotation in opposite directions at substantially equal angular speeds.

The apparatus is provided with a mechanism for feeding the sheets to be worked into the machining zone and means for inducing a magnetic field, including a magnetic circuit arranged at least at the side of the first ends of the rolls, for the magnetic lines of the magnetic flux to extend axially of the rolls and to cross the gap therebetween. In this structure one of the rolls acts as one of the pole pieces of the magnetic system, while the other roll acts as the other pole piece of the same system, whereby particles of the abrasive powder are retained in the gap between the rolls in the process of machining.

The abovespecified apparatus has already proved its operational merits. It provides two-side working of semi-finished printed boards, i.e. of printed board blanks, by which working either the metal oxide layer of the protective coating film are removed from the sheet surface, and the surface attains the required degree of roughness ensuring dependable adhesion of the photoresist layer to the blank surface during the subsequent processing.

The ferromagnetic powder used as the working medium is both inexpensive and readily available.

A particular advantage of the abovespecified apparatus is its ability to process extra-thin printed board blanks (as thin as 0.03 mm) in a substantially continuous process, i.e. on the conveyor technique basis.

However, experience has proved that in the process of the machining performed by the abovespecified apparatus, the work passing between the rolls is machined more intensely at its edges than at the central portion, so that more material is removed off the work at the edge areas than at the centre. This means that the machining over the entire surface is not adequately uniform, which affects the quality of the machined work, e.g. of printed boards.

It is an object of the present invention to provide an apparatus for working with ferromagnetic powder, which should provide for uniform machining of a sheet workpiece over its entire surface area.

It is another object of the present invention to improve the quality of the machining.

These and other objects are attained in an apparatus for working sheet materials with ferromagnetic powder, comprising a magnetic system for retaining the powder, said magnetic system defined by rolls made of a magnetically conductive material spaced to define therebetween a gap for the passage of the material being worked, an inducer of the magnetic flux, arranged at least at the first face ends of the rolls, for the magnetic lines to extend axially of the rolls and to cross the gap wherein, with the rolls rotating, the ferromagnetic powder is pulled in a layer, which apparatus, in accordance with the present invention, further comprises a device for levelling out the distribution of the grains of the powder in the said layer throughout the length of the gap between the magnetic rolls.

The herein disclosed invention is based on the fact that non-uniform distribution of the ferromagnetic powder longitudinally of the rolls occurs on account of the magnetic rolls exhibiting definite, however small, resistance to the passage of the magnetic flux therethrough, whereby non-uniformity takes place in the distribution of the magnetic flux in the gap therebetween longitudinally of the machining zone. In the areas of the machining zone, adjoining the coils inducing the magnetic flux, the intensity of the magnetic flux is somewhat higher than in the central area of the machining zone.

The abovedescribed phenomenon results both in the quantity of the ferromagnetic powder retained by the magnetic flux and the density thereof being non-uniform longitudinally of the magnetic rolls, and, consequently, over the machining zone. Therefore, a sheet workpiece passing between the magnetic rolls is more intensely machined at the edge areas of the machining zone than in the central area thereof; i.e. it is machined non-uniformly over the surface area thereof, the edge areas being machined more intensely, and the central area less intensely.

The introduction by us of the device for levelling out the distribution of grains of the magnetic powder, arising from the otherwise non-uniform magnetic flux, as it has been alrealy mentioned, provides for substantially uniform intensity of the machining over the entire work area, and, consequently, the enhanced quality of the machining of sheet material.

The devices and means for ensuring the uniformity of the distribution of the grains of the ferromagnetic powder vary.

In one embodiment of the present invention the levelling out of the distribution of the ferromagnetic powder is provided for by tapering portions at the extremities of the magnetically conductive or permeable rolls, i.e. in the zone of the most intense magnetic flux at the ends of the rolls. This embodiment is the simplest from the structural realization point of view. It provides for a decrease of the magnetic induction or flux density at the extremities of the rolls, because the magnetic lines have to cross the air gap in their travel from one roll to the other one, and this gap offers considerable resistance to the passage of the magnetic flux, the magnetic permeability of air being as it is thousands to dozens of thousands times smaller than that of iron and special-purpose electrical engineering steels, the exact proportion being dependent on the magnetic saturation characteristics of the iron and steels. So, it is obvious that but a small increase of the operational air gap by the provision of the tapering portions of the magnetic rolls in the area of the relatively higher density of the magnetic flux is capable of levelling out the magnetic induction throughout the working gap, and, hence, the distribution of the powder in the layer.

The uniformity of the distribution of the ferrite powder longitudinally of the working gap is significantly enhanced by the tapering being done along a smooth curve, so that the rolls acquire a barrel-like shape.

This can be explained by the fact that variation of the magnetic permeability of iron and other electrical engineering materials is not directly proportional to the varying value of the magnetic induction longitudinally of the magnetic roll, but is governed by laws specific for each individual magnetically conductive or permeable material.

The optimum shape of the generatrix of the curvilinear working surface of the magnetic rolls can be calculated with the use of the known formulae of magnetic fluxes. These formulae, however, are complicated and offer the resultant accuracy well short of 10 percent; therefore, we deem it not necessary to describe it in detail here. Let us say that the final shape of the generatrix of the barrel-shaped magnetic roll is best found by experience for each individual design of the apparatus for working sheet materials.

Alternatively, the device for levelling out the distribution of the ferromagnetic powder may include a knife with a blade spaced from the rolls by a distance determining the height of the layer of the ferromagnetic powder with respect of the roll surface. The blade of the knife is preferably longitudinally curvilinear, its concave side facing the roll, whereby the edge of the blade is more remote from the magnetic rolls in the zone with the smaller magnetic flux density than in the zone where this density is greater.

The incorporation of the device for levelling out the distribution of the ferromagnetic powder, including the knife mechanically removing the surplus part of the layer of the ferromagnetic powder retained on the rolls by the magnetic field, provides for passing the ferromagnetic powder through the working gap in a predetermined quantity, as well as for adjusting easily the quantity of the ferromagnetic powder fed into the machining zone by varying the spacing of the knife from the magnetic roll. As it has been already stated, the blade of the knife is preferably longitudinally curvelinear to be more remote from the magnetic roll in the areas with the smaller magnetic flux density, where the layer of the ferromagnetic powder is similarly less dense, than in the areas with the greater magnetic flux density, and, hence, the greater density of the ferromagnetic powder.

The structure with the levelling-out device including the blade removing the surplus ferromagnetic powder in the areas of the latter's increased density, by the edge of the blade in these areas not permitting the passage of a thick layer of the powder into the machining zone, enables to adjust the feed of the ferromagnetic powder into the machining zone so that its quantity is substantially uniform throughout the working gap between the rolls.

With the distribution of the ferromagnetic powder in the working gap thus levelled out, it is possible to have the magnetic rolls with a rectilinear generatrix, to adjust, whenever necessary, the height of the layer of the ferromagnetic powder on the rolls and to obtain sheet materials machined in the presently described apparatus with adequate uniformity of the machining over the entire surface of a sheet workpiece. The blade of the knife may extend along the magnetic rolls. However, the ferromagnetic powder has been found to redistribute itself more uniformly throughout the working gap when the apparatus includes the knife with the curvilinear blade having two portions extending at an angle to the generatrix so that they partly enclose the surface of the adjacent magnetic roll and toe-in from the extremities of the roll toward the center thereof, thus additionally urging the ferromagnetic powder toward the centre of the roll. This has been found to preclude the phenomena of the ferromagnetic powder accumulating in a rotating blob in the areas of its maximum removal by the blade. The inclined portions of the blade have been found to efficiently guide the ferromagnetic powder to the center of the magnetic roll, to be taken up by the magnetic flux.

It is also possible to provide the device for levelling out the distribution of the magnetic powder by the specific structure of the magnetic rolls, ensuring the varying magnetic permeability longitudinally of the rolls, with the central portion being of a higher permeability than the end portions.

In one embodiment of the present invention this varying magnetic permeability is attained by the corresponding chemical, or else thermal/chemical treatment of the roll material.

In an embodiment of a more simple structure the rolls are assembled as laminations or stacks of washers made of electrical engineering steel grades of different magnetic permeability values, received around a magnetically permeable rod or core. The washers making up the extreme portions of the magnetic rolls, adjoining the electric coils of the magnetic system, are made in this case of sheet steel with a smaller magnetic permeability than that of the washers making up the central portion of the magnetic rolls. The rod or core in this case should be made of steel with high magnetic permeability, so that it should pass the magnetic flux in a quantity providing that the magnetic induction or flux density in the washers of the central portion should be substantially equal to that in the washers of the extreme portions of the magnetic rolls.

The present invention will be further described in connection with its embodiments in an apparatus incorporating a powder layer levelling-out device, with reference being had to the accompanying drawings, wherein:

FIG. 1 schematically illustrates the embodiment of the apparatus for working sheet materials, wherein the device for levelling out the layer of the ferromagnetic powder in the working gap is in the form of tapering portions at the extremities of the magnetic rolls, in the area of the relatively high density of the magnetic flux;

FIG. 2 schematically illustrates a version of the above embodiment, with the tapering portions being such that the rolls acquire a barrel-like shape;

Figure 1:
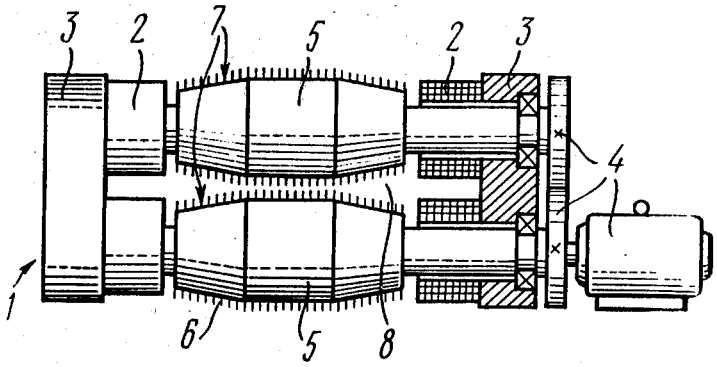

Let us now consider FIG. 1 of the appended drawings, wherein numeral 1 is used to indicate in general an apparatus for working sheet materials with ferromagnetic powder, described in detail in the Application filed with the U.S. Patent Office in 1975, Ser. No. 629,631, now U.S. Pat. No. 4,040,209 to which reference is hereby made. Consequently, there is no need here to describe this apparatus in great detail, and it is seemed sufficient to refer to its major parts whenever essential for the clarity of the present disclosure.

The apparatus is provided with electric coils 2 designed to induce a magnetic flux in the system, magnetic circuits 3 and a drive 4 for rotating magnetic rolls 5 on which the magnetic flux is capable of retaining ferromagnetic powder 6. As it has been already stated, and as described in detail in the above-cited previous application, the rolls are spaced to pass therebetween the sheet material to be machined and act as the pole pieces of a single magnetic system. The rolls 5 are adapted to be rotated in operation in opposite directions at substantially equal angular speeds, so that the powder retained thereby effects the machining of the passing sheet material, with the ferromagnetic powder forming a layer in the gap between the rolls.

The rolls 5 have tapering portions 7 at their extremities, i.e. in the areas of the relatively higher density of the magnetic flux. These tapering portions 7 in the presently described embodiment constitute the device for levelling out the distribution of the ferromagnetic powder 6 in the layer extending longitudinally of the magnetic rolls 5, in the gap therebetween. This levelling-out is explained by the air gap 8 between the said rolls 5 having the magnetic resistance or reluctance far greater than that of the metal elements of the magnetic rolls 5, whereby but a slight variation of the air gap 8 invariably leads to a redistribution of the density of the magnetic flux therein. Therefore, the appropriate selection of the diameters of the magnetic rolls 5 and of the taper angles of their extremities enables to level out the magnetic flux density throughout the entire gap between the magnetic rolls 5, and, consequently, the quantity of the ferromagnetic powder in the central and extreme portions of the magnetic rolls, so that the powder is more uniformly distributed, whereby the machining intensity becomes more uniform, with the resulting substantially uniform treatment of the entire area of a sheet workpiece.

By calculations which are too voluminous to be quoted here and by the outcome of a vast number of experiments we have conducted with various roll dimensions, it has been found, for instance, that with the roll diameter of 120 mm and its length of 300 mm the difference between the diameter of the central portion and the minimum diameter of the tapering portions is not in excess of 1 mm.

It should be pointed out that in the embodiment described the electric coils 2 providing the magnetic flux are arranged at both ends of the magnetic rolls 5 of the apparatus, and the tapering portions, consequently, are provided at both ends of the rolls 5. It is clear, however, that in structures where the coils are arranged solely at the first ends of the rolls, the tapering portions should be provided exclusively in the extreme portions of the rolls, adjoining the coils.

Figure 2:
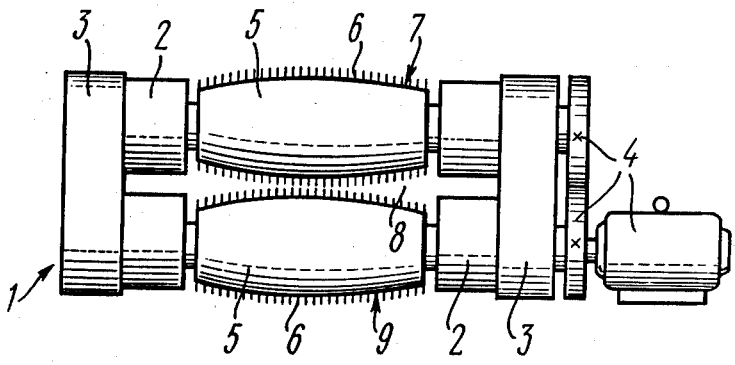

In FIG. 2 there is schematically illustrated another embodiment of the apparatus for working sheet materials in accordance with the invention.

In this figure and in FIG. 1 like components of the apparatus are indicated with like numerals. The same is true of the rest of the appended drawings.

The apparatus illustrated in FIG. 2 differs from the one illustrated in FIG. 1 in the shape of the tapering portions. In the embodiment illustrated in FIG. 2 these tapering portions follow a smooth curve 9, so that the rolls acquire the shape of barrels with the smoothly curving extreme portions. The manufacture of the magnetic rolls of this shape is somewhat more complicated that that of the magnetic rolls with rectilinearly tapering portions; however, the barrel-shaped rolls have been found to provide for more uniform distribution of the grains of the powder throughout the length of the working gap, whereby the machining quality of sheet materials is enhanced still further.

Let us briefly discuss the operation of the apparatus of the abovedescribed embodiments, presuming that its major aspects are sufficiently explained in the above-cited previous application.

The coil 2 are supplied with electric current, whereby magnetic flux is established in the magnetic system, passing through the magnet circuits 3 and the magnetic rolls 5 and closing up in the working gap 8 between these rolls. The magnetic flux retains the ferromagnetic powder 6 on the rolls 5, which, with the rolls 5 being rotated so that their peripheries have the linear-speed exceeding that of the motion of the sheet workpiece, effects the abrasive working of the surface of the workpiece.

With the dimensions of the tapering portions properly selected, the ferromagnetic powder is uniformly distributed throughout the entire working gap 8 longitudinally of the magnetic rolls 5, notwithstanding the fact that the material of the rolls 5 offers some resistance to the passage of the magnetic flux.

If we remember that the reluctance of the air gap filled with the ferromagnetic powder is significantly greater than the reluctance of a magnetically conductive or permeable material, e.g. steel, it is quite understandable that the non-uniformity of the magnetic flux longitudinally of the magnetic rolls is easily compensated for by a variation of the height of the air gap between the magnetic rolls.

By either increasing or reducing the size of the gap 8 between the magnetic rolls 5 by varying the geometry of the tapering portions of the rolls, the magnetic flux passing through this gap in the respective areas is, correspondingly, either reduced or increased.

By taking into consideration the entire pattern of the resistance or reluctance to the magnetic flux passing through the magnetic rolls and the air gap therebetween, it is possible, by varying the value of this gap, which is greated in the areas of the tapering portions, to attain the uniformity of the passage of the magnetic flux throughout the working gap so that the powder layer becomes uniformly distributed in the gap between the rolls.

Figure 3:
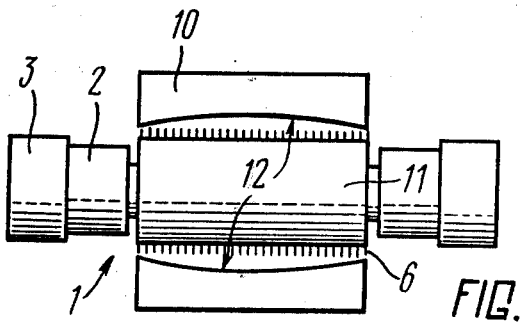
FIG. 3 illustrates the apparatus for working sheet materials, wherein the device includes a knife with a blade extending along the magnetic roll.

Let us now consider FIG. 3 schematically illustrating a different embodiment of the apparatus for working sheet materials, incorporating a device for levelling out the distribution of the ferromagnetic powder, including a knife.

Unlike the embodiments described hereinabove, the apparatus illustrated in FIG. 3 has the device for levelling out the layer of the ferromagnetic powder, which is a mechanical appurtenance including an arcuate knife 10 having its concave edge facing the cylindrical magnetic roll 11 so that the blade 12 of the knife 10 is more remote from the magnetic rolls at the central portion of the rolls, i.e. at the portion with a lower density of the magnetic flux, than at the extremities of the rolls, i.e. in areas with the greater density of the magnetic flux.

FIG. 3 is a plan view of the apparatus with the knives 10 arranged to both sides of the magnetic roll 11. This structure is preferable when sheet workpieces are machined by a method including reversing the rotation of the magnetic rolls, the essence of this method being the subject-matter of another invention disclosed in our co-pending application.

However, when relatively thick workpieces, (e.g. thicker than 0.2 mm are worked), and the rolls are rotated in permanent directions and are not reversed, it is sufficient to provide but the single knife 10 at one side of the magnetic roll, i.e. on the side of the feed of the ferromagnetic powder into the zone of machining by the magnetic roll.

Figure 4:
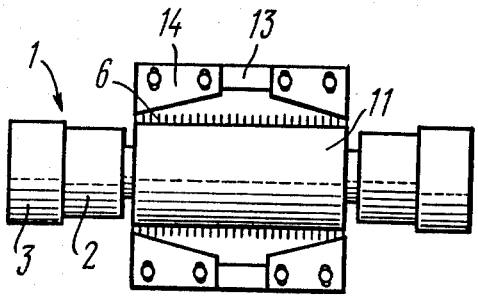
FIG. 4 illustrates an apparatus basically similar to the one illustrated in FIG. 3, but with the knife made up of individual sections adjustable relative to the roll.

FIG. 4 schematically illustrates yet another embodiment of the invention, with a further modification of the device for levelling out the distribution of the layer of the ferromagnetic powder in the gap between the magnetic rolls. The device includes a holder 13 and blades 14 mounted on the end portions of the holder 13, to different sides of the centre of the roll, the blades 14 extending along the generatrix of the adjacent roll which has a cylindrical shape, but at an angle to the surface of this cylindrical roll. The blades are mounted so that their spacing from the roll is adjustable, whereby in operation it is possible to adjust the blades 14 to a position whereat the ferromagnetic powder layer is uniformly distributed throughout the length of the rolls.

Figure 5:
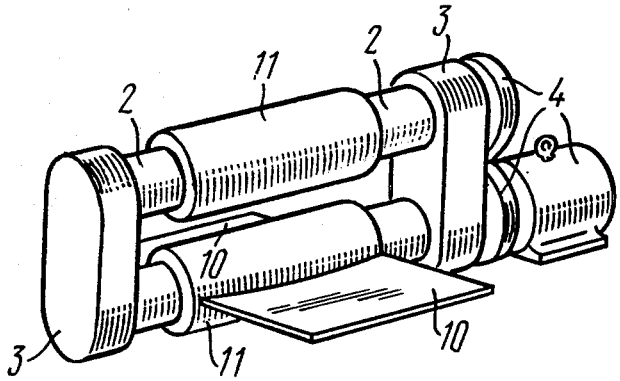
FIG. 5 is a perspective view of the apparatus with the knife of which the blade extends along the magnetic rolls.

FIG. 5 is a perspective view of the device for levelling out the distribution of the ferromagnetic powder in the magnetic gap between the rolls. This view is meant to make the arrangement of the blades and of the knife along the generatrices of the magnetic roll more clear.

Figure 6:
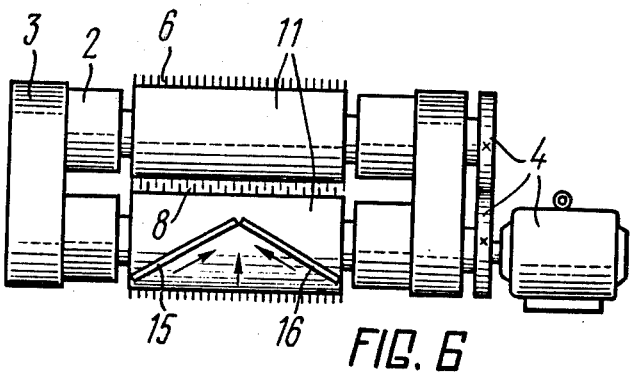
FIG. 6 illustrates another embodiment of the apparatus for working sheet materials, wherein the blades are arranged at an angle relative to the generatrix of the magnetic rolls.
Figure 7:
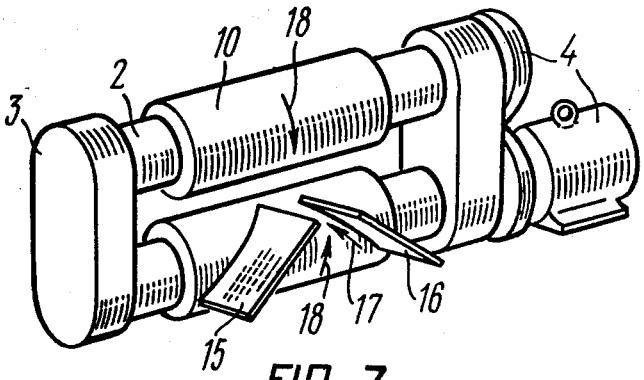
FIG. 7 is a perspective view of the apparatus of FIG. 6.

FIG. 6 shows yet another embodiment of the device for levelling out the powder layer in the apparatus for working sheet materials with ferromagnetic powder, this device likewise including a knife of which, however, the design and arrangement are different from those described hereinabove in connection with FIGS. 3 and 4. In the presently described embodiment the knife has blades 15 and 16 arranged to opposite sides of the center of the generatrix of the roll, the blades partly enclosing the surface of the adjacent roll 11 by being positioned at an angle to the generatrix of this roll and toeing in toward the gap 8. The angle between the generatrix and the blades should be selected to provide for intense guiding of the ferromagnetic powder from the peripheral extreme portions of the roll toward the centre thereof. FIG. 7 illustrates the device of FIG. 6 in a perspective view and clearly shows, as indicated with arrows 17, how the powder is urged from the extremities of the rolls toward the centre thereof, arrows 18 indicating the direction of the rotation of the rolls.

It is clear that in every modification of the apparatus for working sheet materials with ferromagnetic powder, incorporating the device for levelling cut the powder layer, including the knife, the rolls themselves can be either of a cylindrical shape or of a barrel-like shape.

The operation of the apparatus incorporating the levelling knives is substantially similar to the apparatus of the prior art and the apparatus described hereinabove in connection with FIGS. 1 and 2. The difference resides solely in that the knives mechanically remove or cut off some portion of the ferromagnetic powder 6 in areas with the greater density of the magnetic flux, instead of varying this density of the flux in these areas, as it has been the case with the apparatus illustrated in FIGS. 1 and 2.

Let us discuss certain peculiarities associated with the incorporation of the knives. The height of the layer of the ferromagnetic powder 6 which is left on the magnetic rolls is adjustable by displacing the blade of the knife toward and away from the working surface of the magnetic roll 11. The use of a curvilinear blade of the knife enables to leave the layer of the ferromagnetic powder 6 on the rolls 11, of which the height is non-uniform longitudinally of the rolls, this height being smaller at the extremities than at the centre. However, with the density of the layer of the ferromagnetic powder retained by the magnetic flux being greater at the extremities of the magnetic rolls 11 than at their centre, the resulting quantity of the ferromagnetic powder 6 carried into the machining zone is equalized or levelled out throughout the length of the gap between the magnetic rolls 11. Therefore, there is effected the removal of the uniform surface layer of the material being machined by the grains of the ferromagnetic powder 6, which grains cut into the surface of the sheet material advanced through the machining zone.

To provide for varying machining conditions, it is expedient that the knives should be mounted so that the spacing of their blades from the surface of the rolls 11 is adjustable.

The most structurally simple arrangement of the knives is the one where they extend longitudinally of the magnetic roll 11.

However, we have found by experience, that at the areas where the greatest amount of the powder is being removed in the structures with the blade extending longitudinally of the magnetic roll, there are sometimes accumulated relatively great blobs of the ferromagnetic powder, which gradually move along the knife toward the centre of the roll 11, to be taken up by the latter.

The accumulation of the blobs of the powder on the knives has been found to impair the performance of the apparatus.

The cut-off or removed portion of the ferromagnetic powder is significantly more swiftly redistributed from the zone with the greater magnetic flux intensity into the zone with the smaller magnetic flux intensity, without considerable blobs of the ferromagnetic powder being formed, in the apparatus wherein the blade of the knife extends at an angle to the generatrix of the adjacent roll, partly enclosing the roll surface, as it is illustrated in FIGS. 6 and 7.

The experiments we have conducted show that when the knife position relative to one of the rolls is adjusted so that the ferromagnetic powder is uniformly distributed in the gap between the rolls, the layer of the ferromagnetic powder on the other roll is automatically maintained in similarity with the layer on the first roll. Thus, it is obvious that the knife can be arranged adjacent to either one of the two rolls, be it the upper one or the lower one. However, it has been found expedient to provide the knife adjacent to the bottom roll in structures where the additional feed of the ferromagnetic powder is effected from a tray underlying the magnetic rolls, or else adjacent to the upper roll if the metered-out additional feed of the ferromagnetic powder is effected from above.

It should be also born in mind that it is possible to have various combinations of the abovedescribed features, i.e. of the knives and barrel-shaped rolls, and that the selection of the overall design of the apparatus is determined by the machining quality requirements and by the relative complexity of the manufacture of the levelling-out device.

Figure 8:
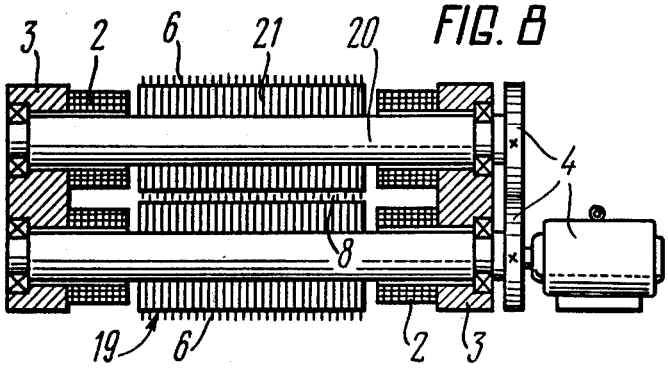
FIG. 8 is an embodiment of the apparatus, wherein the magnetic rolls are assembled of washers received around a magnetically permeable core.

Let us now consider FIG. 8 showing schematically still another embodiment of the apparatus for working sheet materials with ferromagnetic powder, in a longitudinal sectional view, wherein the device for levelling out the ferromagnetic powder layer is in the form of a modified structure of the magnetic rolls.

The apparatus differs from those described hereinabove in that the magnetic rolls are so constructed that the magnetic permeability of their central portion is higher than the permeability of their extreme or end portions.

A magnetic roll of this type can be made of a material of which the chemical composition varies longitudinally of the roll, or else by some specific thermal treatment, e.g. by hardening the extreme portions, or else by carburizing the roll with a varying carburization depth, and with leaving the central portion of the roll unhardened, or uncarburized. However, it is clear that the techniques of obtaining a roll with the different magnetic permeability values of the central and extreme portions are complicated.

Still, it is possible to have a roll with different magnetic permeability of the central and end areas, by assembling the roll of a stack of washers or discs of electrical engineering steel grades with different magnetic permeability values, received about a magnetically permeable rod or core.

As it can be seen in FIG. 8, the magnetic roll 19 has a central core 20 of a high magnetic permeability, having received thereabout and fixed a stack of washers 21 of electrical engineering steel, defining the roll 19. The washers are made of materials with different values of magnetic permeability, the magnetic permeability values of the materials of the washers being selected so that the portions of the made-up magnetic rolls 19, adjoining the solenoid coils 2, are made of washers with the smallest magnetic permeability, so that the closer the washers become to the centre, the greater is their magnetic permeability.

Let us briefly discuss the operation of the apparatus illustrated in FIG. 8.

The magnetic flux created by the solenoid coils 2 passes through the magnetic cores 3 and the rod or core 20 of the high magnetic permeability, in which way the flux is guided into the magnetic rolls 19.

Although the rods 20 are made of a material with the high magnetic permeability, they nevertheless offer some resistance to the passage of the magnetic flux. The flux also passes from one magnetic roll 19 through the air gap 8 into the other magnetic roll 19. Therefore, the magnetic induction or flux density in the cores 20 is higher in the areas adjoining the solenoid coils 2 than at the centres of these cores 20. By selecting the washers 21 so that the permeability of the washers adjoining the solenoid coils 2 is lower than the permeability of the washers in the central portion, the uniform density of the magnetic flux throughout the length of the air gap 8 between the rolls 19 can be attained. This is explained by the fact that although the magnetic flux guided in operation via the core 20 to the internal diameter of the washers 21 has a greater density in the areas adjoining the solenoid coils 2 than in the central portion of the magnetic roll 19, this flux passes with more difficulty to the external diameter of the roll 19 through the washers 21 made of the material with the lower magnetic permeability, whereby the greater portion of the flux passes through the washers 21 with the higher permeability, which are gathered in the central portion of the roll 19; which means that by selecting the appropriate pattern of arranging the washers 21 with the different values of the magnetic permeability, it is possible to attain the uniform density of the magnetic flux longitudinally of the working gap 8, thus levelling out the layer of the ferromagnetic powder 6 retained by the magnetic flux on the rolls 19, whereby the sheet material is machined uniformly over the entire area thereof.

If the sufficient amount or assortment of washers with different values of the magnetic permeability is unavailable, the gradual required variation of the magnetic permeability longitudinally of the air gap can be attained by having a combination structure, using both washers of different magnetic permeability values and the powder-removing blades, or else them and the tapering portions at the ends of the rolls.

What is claimed is:

1. In an apparatus for working sheet materials with ferromagnetic powder, comprising a magnetic system adapted to retain the ferromagnetic powder, including two rolls of a magnetically permeable material, mounted with a gap left therebetween for the passage of the material to be worked and rotatable in opposite directions, and means for inducing a magnetic flux with a magnetic circuit provided at least at the side of the first ends of the rolls, so that the magnetic lines of the magnetic flux pass axially of the rolls and cross the gap therebetween, one of the two rolls acting as one of the pole pieces of the system, and the other roll acting as the other pole piece of the same system, whereby the ferromagnetic powder can be pulled in operation in the form of a layer through the gap between the rolls, the improvement which comprises tapering portions at the extremities of the magnetically permeable rolls, in an area of the relatively high density of the magnetic flux for levelling out the distribution of the grains of the ferromagnetic powder in the layer formed in the gap between the rolls throughout the length of the gap.

2. An apparatus as set forth in claim 1, wherein the rolls are barrel-shaped.

3. In an apparatus for working sheet materials with ferromagnetic powder, comprising a magnetic system adapted to retain the ferromagnetic powder, including two rolls of a magnetically permeable material, mounted with a gap left therebetween for the passage of the material to be worked and rotatable in opposite directions, and means for inducing a magnetic flux with a magnetic circuit provided at least at the side of the first ends of the rolls, so that the magnetic lines of the magnetic flux pass axially of the rolls and cross the gap therebetween, one of the two rolls acting as one of the pole pieces of the system, and the other roll acting as the other pole piece of the same system, whereby the ferromagnetic powder can be pulled in operation in the form of a layer through the gap between the rolls, the improvement which comprises a knife with a curvilinear blade having its concave edge facing the surface of the adjacent roll so that the blade of the knife is more remote from the magnetic roll in the area where the magnetic flux is lower and is closer to the roll in the area where the density of the magnetic flux is higher for levelling out the distribution of the grains of the ferromagnetic powder in the layer formed in the gap between the rolls throughout the length of the gap.

4. An apparatus as set forth in claim 3, wherein means for inducing the magnetic flux are provided at both extremities of the rolls, and the knife is of a concave arcuate shape, the centre of the blade of the arcuate knife being situated at the central portion of the roll, where the density of the magnetic flux is lower than at the extremities of the rolls.

5. An apparatus as set forth in claim 3, wherein the blade of the knife extends longitudinally of the generatrix of the magnetic roll.

6. An apparatus as set forth in claim 4, wherein the blade of the knife extends longitudinally of the generatrix of the magnetic roll.

7. An apparatus as set forth in claim 3, wherein the blade of the knife includes two portions disposed at opposite sides of the centre of the adjacent roll and extends at an angle of the generatrix thereof, toeing-in toward the gap between the rolls, for the interaction with the blade to guide the powder from the extremities of the roll toward the central portion thereof.

8. In an apparatus for working sheet materials with ferromagnetic powder, comprising a magnetic system adapted to retain the ferromagnetic powder, including two rolls of a magnetically permeable material, mounted with a gap left therebetween for the passage of the material to be worked and rotatable in opposite directions, and means for inducing a magnetic flux with a magnetic circuit provided at least at the side of the first ends of the rolls, so that the magnetic lines of the magnetic flux pass axially of the rolls and cross the gap therebetween, one of the two rolls acting as one of the pole pieces of the system, and the other roll acting as the other pole piece of the same system, whereby the ferromagnetic powder can be pulled in operation in the form of a layer through the gap between the rolls, the improvement which comprises a knife arranged adjacent to the roll onto which additional feed of the ferromagnetic powder is effected during operation for levelling out the distribution of the grains of the ferromagnetic powder in the layer formed in the gap between the rolls throughout the length of the gap.

9. In an apparatus for working sheet materials with ferromagnetic powder, comprising a magnetic system adapted to retain the ferromagnetic powder, including two rolls of a magnetically permeable material, mounted with a gap left therebetween for the passage of the material to be worked and rotatable in opposite directions, and means for inducing a magnetic flux with a magnetic circuit provided at least at the side of the first ends of the rolls, so that the magnetic lines of the magnetic flux pass axially of the rolls and cross the gap therebetween, one of the two rolls acting as one of the pole pieces of the system, and the other roll acting as the other pole piece of the same system, whereby the ferromagnetic powder can be pulled in operation in the form of a layer through the gap between the rolls, the improvement which comprises magnetic rolls having variable magnetic permeability wherein the extreme portions of the rolls have a lower magnetic-permeability than the central portion of the rolls for leveling out the distribution of the grains of the ferromagnetic powder in the layer formed in the gap between the rolls throughout the length of the gap.

10. An apparatus as set forth in claim 9, wherein the magnetic rolls are assembled of washers made of magnetically permeable materials having different magnetic permeability values, mounted on a magnetically permeable core, the washers in the central portion of the roll having a greater magnetic permeability than the washers of the extremities of the rolls.

* * * * *